US007469892B2

(12) United States Patent
Iwase et al.

(10) Patent No.: US 7,469,892 B2
(45) Date of Patent: Dec. 30, 2008

(54) IMAGE FORMING APPARATUS

(75) Inventors: Masaki Iwase, Shizuoka-Ken (JP); Yasuhiro Uchida, Yokohama (JP); Minoru Kawanishi, Shizuoka-Ken (JP); Akira Matsushima, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 485 days.

(21) Appl. No.: 11/248,153

(22) Filed: Oct. 13, 2005

(65) Prior Publication Data

US 2006/0180996 A1 Aug. 17, 2006

(30) Foreign Application Priority Data

Oct. 28, 2004 (JP) ..... 2004-313526
Oct. 3, 2005 (JP) ..... 2005-290534

(51) Int. Cl.
*B65H 1/22* (2006.01)

(52) U.S. Cl. ..... 271/164; 271/145

(58) Field of Classification Search ..... 271/145, 271/162, 164, 207, 9.09, 147; 399/393, 392
See application file for complete search history.

(56) References Cited

U.S. PATENT DOCUMENTS 4,487,406 A * 12/1984 Kabashima ..... 271/127
4,508,260 A * 4/1985 Keir et al. ..... 232/43.1
4,570,548 A * 2/1986 Martin et al. ..... 109/66
4,616,819 A * 10/1986 Makio et al. ..... 271/122
4,780,740 A * 10/1988 Fukae ..... 399/86
4,793,606 A * 12/1988 Yasuoka et al. ..... 271/157
4,835,567 A * 5/1989 Ogata ..... 399/124
5,005,818 A * 4/1991 Hayashi et al. ..... 271/107
5,012,294 A * 4/1991 Sasabe et al. ..... 399/110
5,354,046 A * 10/1994 Hattori ..... 271/147
5,364,088 A * 11/1994 Maruyama et al. ..... 271/164
5,709,381 A * 1/1998 Hourtash et al. ..... 271/147
5,722,654 A * 3/1998 Sootome et al. ..... 271/119
5,823,525 A * 10/1998 Miki ..... 271/127
5,845,899 A * 12/1998 Satoh et al. ..... 271/9.11
6,311,970 B1 * 11/2001 Miyamoto ..... 271/164
6,663,099 B2 * 12/2003 Inoue ..... 271/162

(Continued)

FOREIGN PATENT DOCUMENTS

JP 63277133 A * 11/1988

(Continued)

*Primary Examiner*—Patrick H Mackey
*Assistant Examiner*—Jeremy Severson
(74) *Attorney, Agent, or Firm*—Fitzpatrick, Cella, Harper & Scinto

(57) ABSTRACT

An image forming apparatus in which a sheet containing device containing a sheet is detachably attached to a containing portion provided in an apparatus main body includes an engagement portion provided on the sheet containing device, a drawing device provided in the containing portion to be rotatable using one end thereof as a pivot, and a guide device which, when the drawing device rotates to draw the sheet containing device, guides a movement of the engagement portion in a drawing direction. The guide device is composed of a linear portion parallel to a direction in which the sheet containing device is inserted, and a curved portion provided on a downstream side of the linear portion with respect to a direction in which the sheet containing device is attached, the curved portion being curved not to extend away from the pivot of the drawing device.

9 Claims, 13 Drawing Sheets

U.S. PATENT DOCUMENTS

| | | | | |
|---|---|---|---|---|
| 6,820,872 | B2 * | 11/2004 | Ko et al. | 271/162 |
| 6,863,487 | B2 * | 3/2005 | Behrens et al. | 414/416.03 |
| 7,322,763 | B2 * | 1/2008 | Yang | 400/624 |
| 7,412,200 | B2 * | 8/2008 | Gotoh | 399/393 |
| 2004/0264998 | A1 * | 12/2004 | Uchida | 399/107 |
| 2006/0180996 | A1 | 8/2006 | Iwase et al. | 271/162 |
| 2007/0273084 | A1 * | 11/2007 | Chu et al. | 271/162 |

FOREIGN PATENT DOCUMENTS

| | | | |
|---|---|---|---|
| JP | 4-85220 | | 3/1992 |
| JP | 09012164 | A * | 1/1997 |

* cited by examiner

IMAGE FORMING APPARATUS

BACKGROUND OF THE INVENTION

1. Field of the Invention

The present invention relates to an image forming apparatus, and in particular, an image forming apparatus to which sheet containing means containing sheets is detachably attached.

2. Related Background Art

A conventional image forming apparatus allows sheet containing means containing sheets to be detachably attached to the main body of the image forming apparatus. In such an image forming apparatus, sheets contained in a sheet containing cassette serving as the sheet containing means are successively conveyed to an image forming portion, where image recording is effected on the sheets.

Incidentally, the sheet containing cassette is attached and detached for the purpose, for example, of filling it with sheets or effecting a change in sheet size. When the attachment operation is conducted on the sheet containing cassette after filling it with sheets, the sheet containing cassette, which has become heavy due to the sheets, puts a significant burden upon the user. Further, when the sheet containing cassette is heavy, the user may exert an excessive force at the time of attachment to give the cassette great momentum in the attachment direction thereof, resulting in an impact at the time of attachment. This impact may lead to positional deviation of the sheets filling the sheet containing cassette or damage to the sheet containing cassette.

As means for solving this problem, there is known, for example, an automatic sheet containing cassette conveying mechanism, which, when the insertion of the sheet containing cassette is detected, automatically conveys the sheet containing cassette by the drawing portion, thereby sparing the user the trouble of performing the operation of inserting the sheet containing cassette. In the case of this mechanism, however, automatic conveyance is impossible in a state in which no power is supplied to the apparatus main body. In view of this, there is provided charge means for storing driving power, making it possible to perform automatic conveyance even when no power is being supplied. The provision of such charge means, however, results in a very complicated apparatus construction.

In view of this, Japanese Patent Application Laid-open No. H4-85220, for example, discloses, instead of an automatic sheet containing cassette conveying mechanism using electric power, a mechanical automatic sheet containing cassette conveying mechanism using a spring and needing no electric power. As shown in FIGS. 13A and 13B, in such a mechanical automatic sheet containing cassette conveying mechanism, the conveyance of the sheet containing cassette is performed as follows: by using a toggle spring 120, a rotation moment is generated in an arm 118 rotatable around a shaft 119; the action force of the rotation moment is transmitted to an engagement pin 113 provided on the back surface of the sheet containing cassette; and the engagement pin 113 is drawn along a guide 123 extending linearly in the direction in which the sheet containing cassette is inserted, thereby drawing the sheet containing cassette.

However, in this conventional image forming apparatus adopting a mechanical automatic sheet containing cassette conveying mechanism, when drawing the sheet containing cassette through the engagement pin 113, the arm 118 makes a rotating motion, whereas the movement route for the engagement pin 113 formed by a groove 124 defined by the guide 123 extends linearly in the direction in which the sheet containing cassette is inserted, so that the engagement pin 113 is guided linearly.

Here, when the engagement pin 113 is thus guided linearly, the position of the point of action of the moment on the arm transmitting force to the engagement pin 113 changes every moment as the sheet containing cassette is drawn, and in the end region of the sheet cassette conveyance section, the point of action of the moment with respect to the engagement pin 113 moves away from the shaft 119, the point of action of the moment having been moving toward the shaft 119 of the arm 118 due to the configuration of a grasping groove 118*a* for grasping the engagement pin 113, which is formed at the rotation end of the arm 118.

Further, when the point of action of the moment thus moves away from the shaft 119, which is the rotation center of the arm 118, the conveyance force for drawing the sheet containing cassette is weakened as indicated by symbol a in FIG. 7 (described later). Furthermore, a shortage of conveyance force occurs in the portion where the conveyance resistance to the sheet containing cassette increases due to a spring component, etc. of a detecting sensor or the like for detecting the accommodation of the sheet containing cassette by utilizing a spring. As a result, it is impossible to draw the sheet containing cassette reliably to a desired position.

It might be possible to prevent this shortage of conveyance force by using a strong toggle spring. In this case, however, the requisite operating force for pulling back the toggle spring when drawing out the sheet containing cassette increases, resulting in a deterioration in usability.

SUMMARY OF THE INVENTION

The present invention has been made in view of the above problems in the prior art. It is an object of the present invention to provide an image forming apparatus allowing the sheet containing cassette (sheet containing means) to be reliably drawn without involving a deterioration in usability.

According to the present invention, an image forming apparatus, in which sheet containing means containing a sheet is detachably attached to a containing portion provided in an apparatus main body, includes: an engagement portion provided on the sheet containing means; drawing means which is rotatably provided in the containing portion as a pivot, the drawing means being engaged with the engagement portion and being rotated to draw-the sheet containing means in the containing portion by a spring when the sheet containing means is inserted to the containing portion; and guide means which, when the drawing means being rotated to draw the sheet containing means, guides a movement of the engagement portion in a drawing direction of the sheet containing means, wherein the guide means is composed of: a linear portion parallel to the drawing direction of the sheet containing means; and a curved portion which is provided on the downstream side of the linear portion with respect to the drawing direction, the curved portion being curved not to be away from the pivot of the drawing means.

DESCRIPTION OF THE PREFERRED EMBODIMENTS

In the following, the best mode for carrying out the present invention will be described in detail with reference to the drawings.

Figure 1:
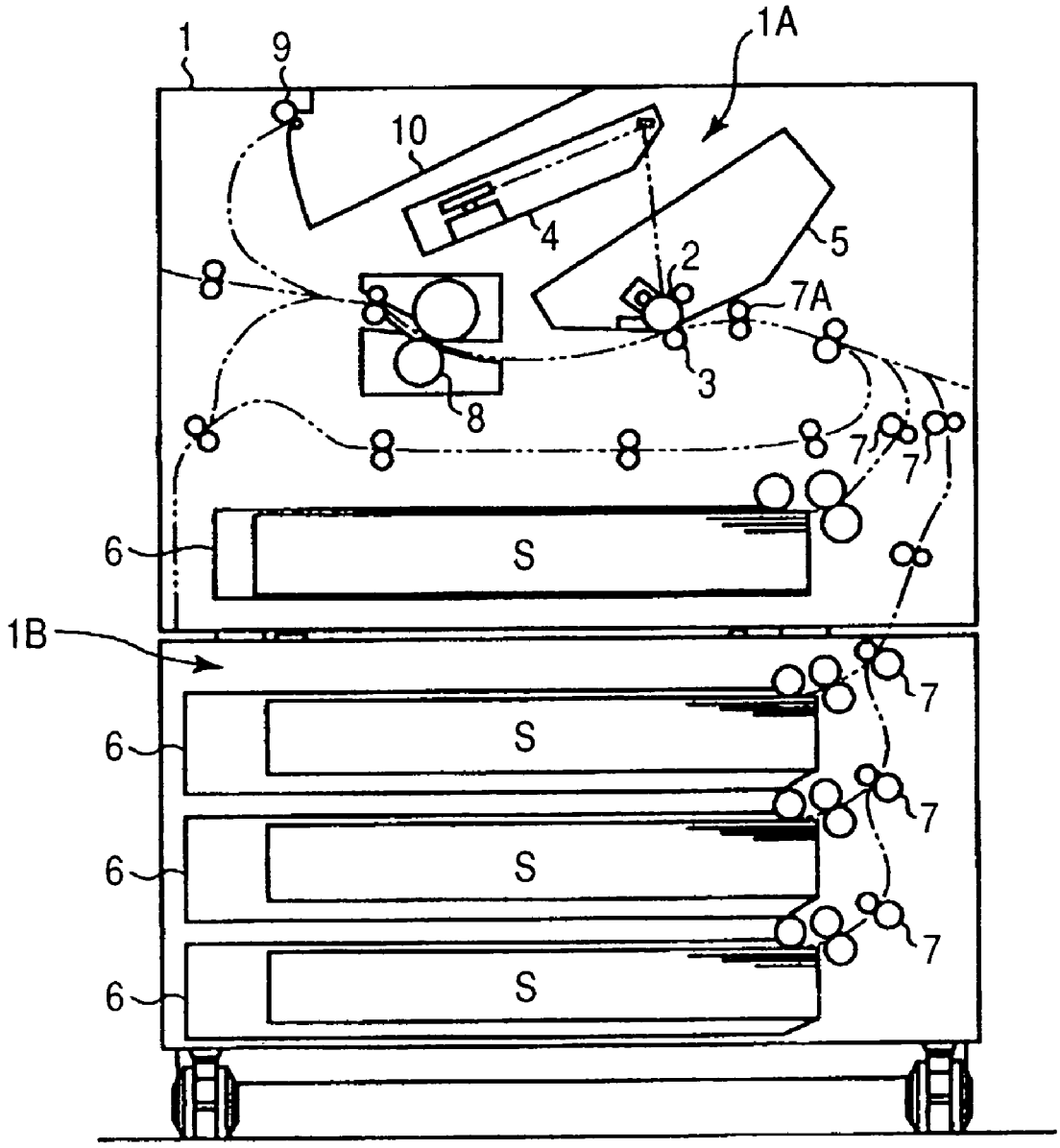
FIG. 1 is a diagram schematically showing the construction of an image forming apparatus according to an embodiment of the present invention.

FIG. 1 is a diagram schematically showing the construction of an image forming apparatus according to an embodiment of the present invention.

In FIG. 1, reference symbol 1 indicates the main body of the image forming apparatus. Reference symbol 1A indicates an image forming portion which is provided in the image forming apparatus main body (hereinafter referred to as "apparatus main body") and which performs image formation by the electrophotographic image forming process. The image forming portion 1A is equipped with a photosensitive drum 2 for forming a toner image, a transferring roller 3 for transferring the toner image formed on the photosensitive drum 2 to a sheet S, etc.

In the image forming portion 1A constructed as described above, when image forming operation is started, a beam corresponding to an image signal is first applied to the photosensitive drum 2 by a laser scanner 4. By thus applying a beam corresponding to an image signal, a latent image is formed on the photosensitive drum 2. Next, this latent image is developed by toner contained in a process cartridge 5, thereby forming a toner image (visible image) on the photosensitive drum.

In parallel with this toner image forming operation, a sheet S is fed from a sheet containing cassette 6. The sheet S is conveyed to a transferring portion formed by the photosensitive drum 2 and the transferring roller 3 by means of conveying rollers 7 and registration rollers 7A in synchronism with the image formed on the photosensitive drum 2. Then, in this transferring portion, a bias is applied to the transferring roller 3, thereby transferring the toner image to the sheet S.

After this, the sheet S, to which the toner image has been transferred, is conveyed to fixing means 8, where the sheet S is heated and pressurized, thereby fixing the toner image to the sheet, which is then discharged onto a delivery portion 10 in the upper portion of the apparatus by delivery rollers 9.

Figure 2:
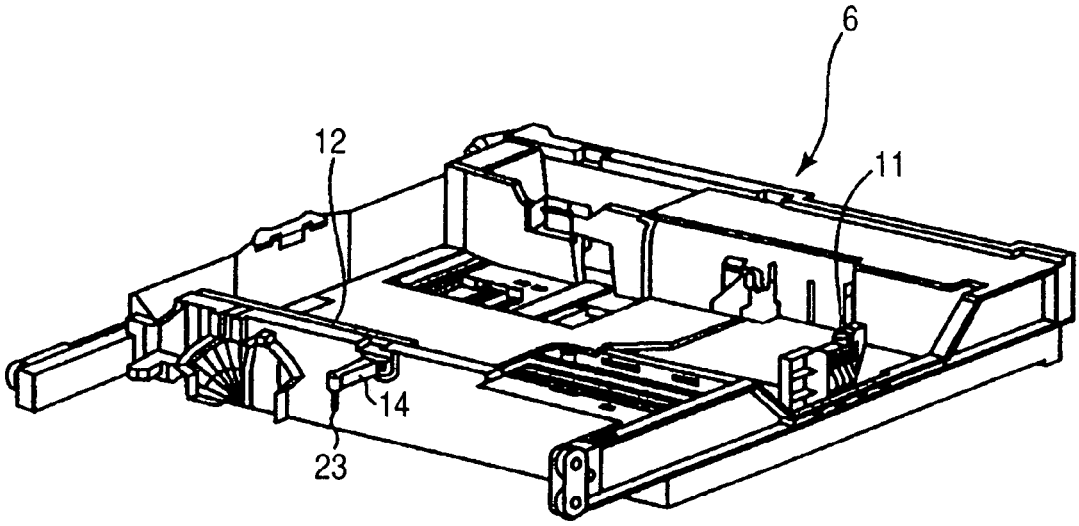
FIG. 2 is a perspective view of a sheet containing cassette to be detachably attached to the main body of the image forming apparatus.

FIG. 2 is a perspective view of the sheet containing cassette 6, which is sheet containing means to be detachably attached to the apparatus main body 1. The sheet containing cassette 6 is equipped with a side regulating plate 11 and a depth regulating plate 12 which allow sliding adjustment so as to be adjusted to an arbitrary sheet size and which serve to fix the sheets in position. Provided on the back surface of the sheet containing cassette 6 are an engagement pin 13, which is grasped by a drawing portion described below when the sheet containing cassette 6 is attached to a containing portion 1B (see FIG. 1) provided in the apparatus main body 1, and a pin retaining arm 14 which retains the engagement pin 13.

The pin retaining arm 14 retaining the engagement pin 13 is rotatable in the lateral direction (direction perpendicular to the attachment direction) with respect to the sheet containing cassette 6 through a shaft 17 described below (shown in FIG. 4). As a result, the engagement pin 13 is held in a floating state in which it is not restricted in lateral movement.

Figure 3:
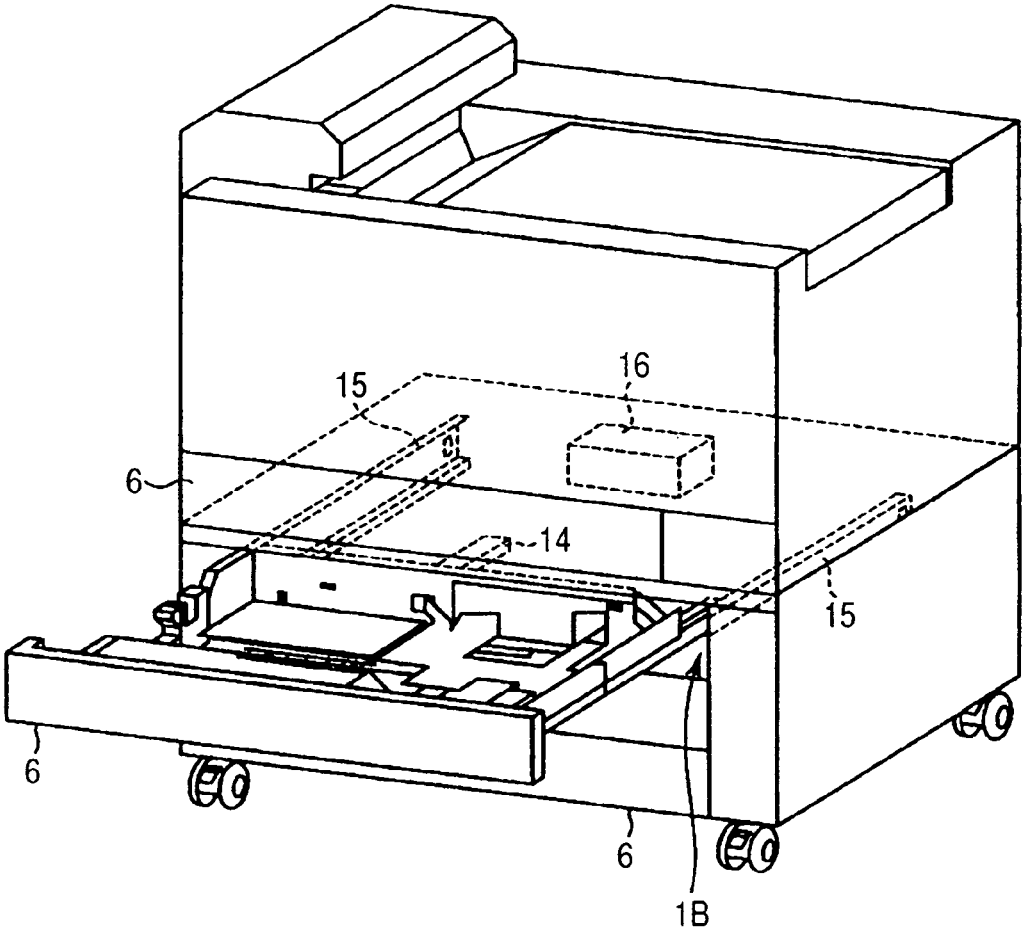
FIG. 3 is a perspective view showing how the sheet containing cassette is attached to the image forming apparatus main body.

When it is attached to the containing portion 1B, the sheet containing cassette 6 is detachably mounted to the apparatus main body 1 along slide guides 15 shown in FIG. 3 arranged on inner walls of the containing portion 1B so as to be opposed to each other.

Incidentally, in FIG. 3, reference symbol 16 indicates a drawing portion provided on the depth side of the containing portion 1B, the drawing portion being engaged with the engagement pin 13 when the sheet containing cassette 6 to be attached to the containing portion 1B reaches a predetermined position and drawing the sheet containing cassette 6 through the engagement pin 13.

Here, the operation of attaching the sheet containing cassette 6 is conducted by the user. When, as a result of the attaching operation, the engagement pin 13 and the pin retaining arm 14 both mounted to the back surface of the sheet containing cassette 6 reach the position of the drawing portion 16, the drawing portion 16 is engaged with the engagement pin 13. When, after this, the sheet containing cassette 6 is further inserted, the pin 13 is drawn in by the drawing portion 16, and the sheet containing cassette 6 is drawn to the feed position.

Figure 4:
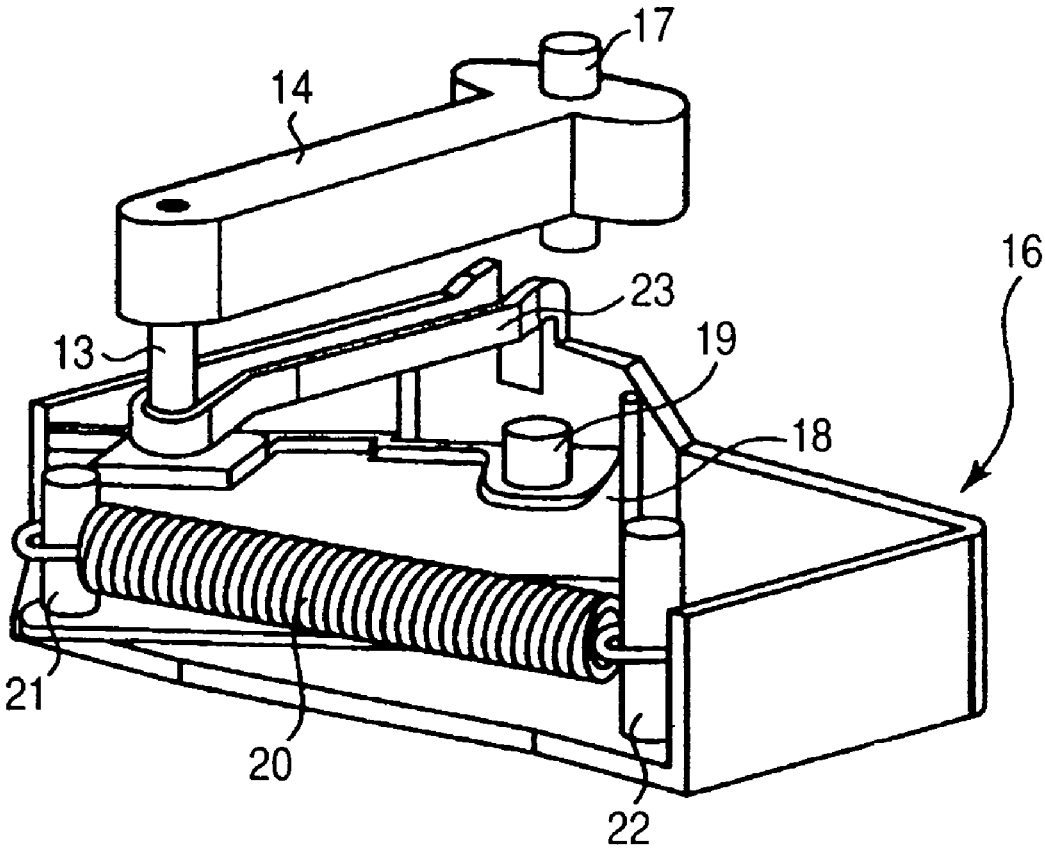
FIG. 4 is a perspective view of a drawing portion provided in the image forming apparatus.
Figure 5A:
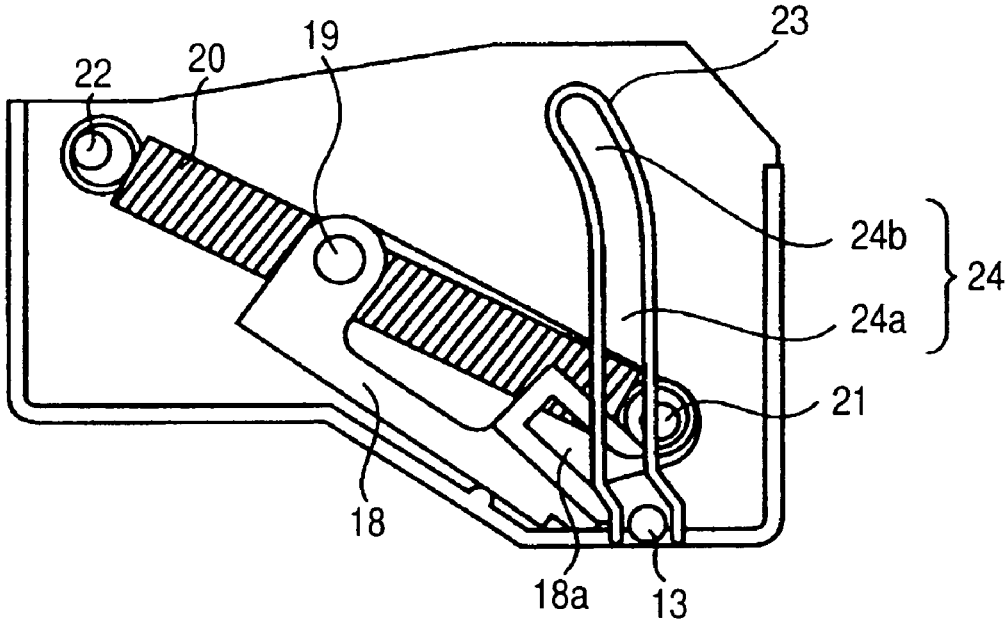
FIGS. 5A and 5B are first diagrams illustrating the sheet containing cassette drawing operation of the drawing portion.
Figure 5B:
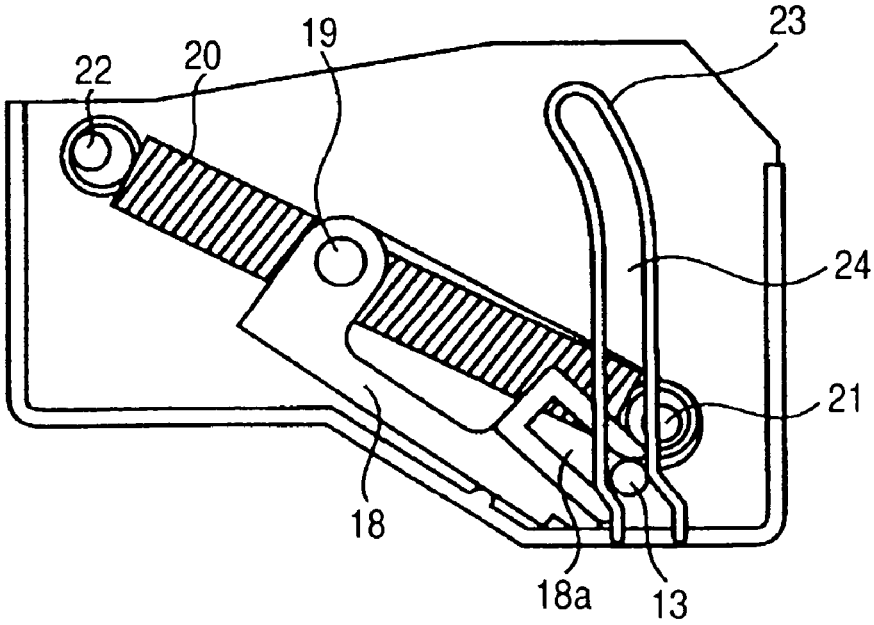

FIG. 4 is a perspective view showing the state of the drawing portion 16 when the sheet containing cassette 6 has been thus drawn to the feed position by the drawing portion 16. As shown in FIG. 4 and FIGS. 5A and 5B (referred to below), the drawing portion 16 is composed of: an arm 18 which grasps the engagement pin 13, i.e., the engagement portion provided on the back surface of the sheet containing cassette 6, that is, on the surface at the end with respect to the attachment direction of the sheet containing cassette 6, the arm serving as rotatable drawing means for drawing the sheet containing cassette 6 through the engagement pin 13; a shaft 19 constituting the rotation center of the arm 18; a toggle spring 20 which is connected to the arm 18 and which is adapted to generate a rotation moment in the arm 18 by its contracting force to provide the force to draw the sheet containing cassette 6; a toggle spring peg 21 provided on the arm 18 and connecting the arm 18 and the toggle spring 20; a shaft 22 constituting the rotation center of the toggle spring 20; a guide member 23 which is guide means having a guide groove 24 serving as a groove for guiding the engagement pin 13, etc. At the rotation end of the arm 18, there is formed a grasping groove 18*a* for grasping the engagement pin 13.

Figure 9:
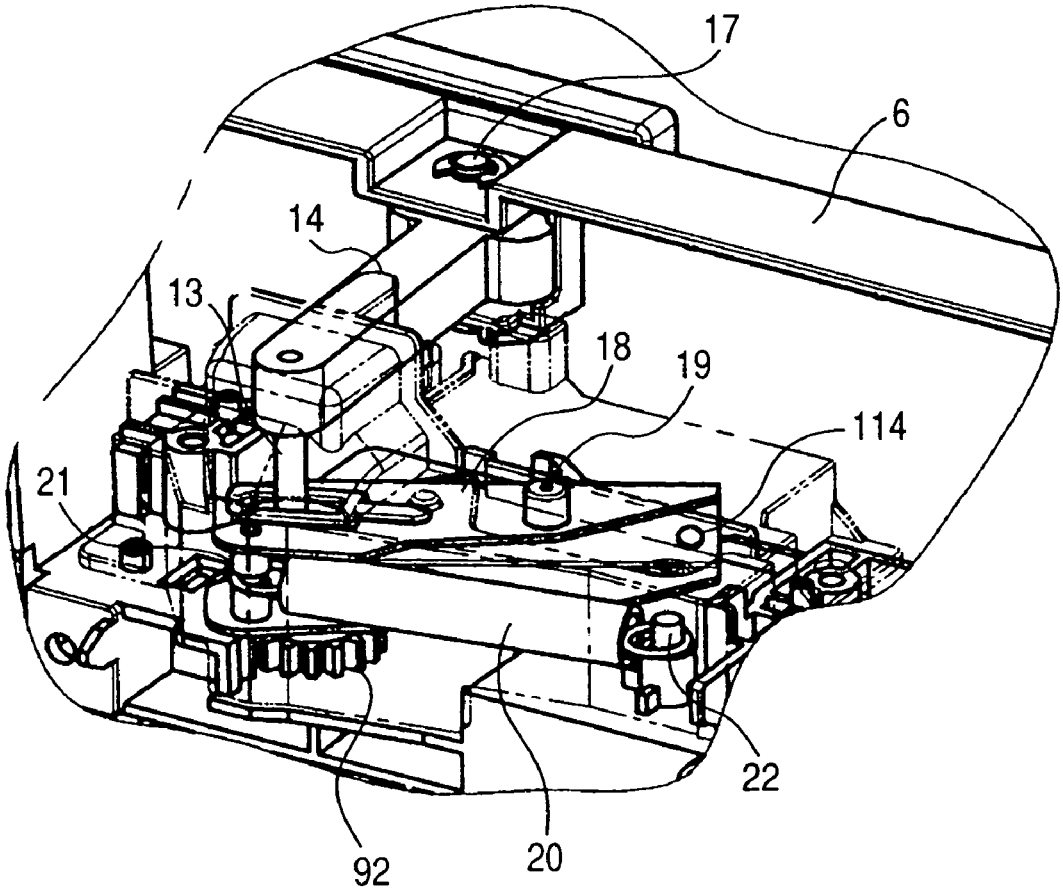
FIGS. 9 is a perspective view of a drawing portion according to another embodiment of the present invention.

When, as in the case, for example, of FIGS. 9A and 9B, the engagement pin 13 is drawn straight, the point of action of the rotation moment of the engagement pin 13 is moved away from the rotation center of the arm 18, resulting in a reduction in action force and in conveyance force.

In view of this, in this embodiment, in the drawing portion 16, which draws the sheet containing cassette 6 by the spring force of the toggle mechanism, the downstream end portion with respect to the inserting direction of the guide groove 24 of the guide member 23 corresponding to the end region of the drawing section, which is a portion where the conveyance resistance to the sheet containing cassette increases due to a spring component, etc. of a detecting sensor or the like, is formed as an arc whose center is the shaft 19 of the arm 18. As a result, the point of action of the moment of the engagement pin 13 is prevented from being moved away from the shaft 19, which is the rotation center of the arm.

That is, as shown in FIGS. 5A and 5B, in this embodiment, the guide groove 24 of the guide member 23 is composed of: a linear portion 24*a* which is parallel to the cassette inserting direction; and a curved portion 24*b* provided on the downstream side of the linear portion 24*a* with respect to the attachment direction and curved so as not to extend away from the shaft 19, which is the pivot of the arm 18. As a result, the point of action of the moment of the engagement pin 13 is prevented from being moved away from the shaft 19, which is the rotation center of the arm 18.

Next, the operation of drawing the sheet containing cassette 6 performed at the drawing portion 16 thus constructed will be illustrated.

First, the sheet containing cassette 6 is inserted into (attached to) the containing portion 1B through manipulation by the user. When the engagement pin 13 reaches the position as shown in FIG. 5A, the engagement pin 13 is guided by the guide member 23, and thereafter, as shown in FIG. 5B, enters a grasping groove 18*a* formed at the rotation end of the arm 18. As a result, a state is attained in which the arm 18 grasps the engagement pin 13.

Figure 6A:
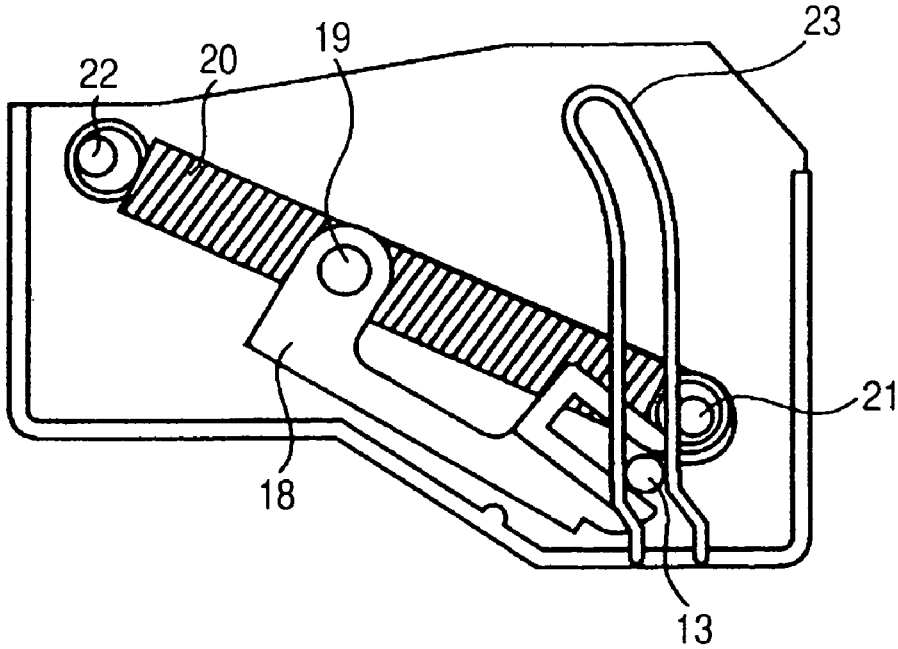
FIGS. 6A and 6B are second diagrams illustrating the sheet containing cassette drawing operation of the drawing portion.

Next, when the sheet containing cassette 6 in this state is further inserted, the engagement pin 13 gradually moves to the depth side of the grasping groove 18*a* while pressurizing the arm 18. Then, by being thus pressurized by the engagement pin 13, the arm 18 rotates using the shaft 19 as the pivot. Further, by this rotation of the arm 18, the toggle spring peg 21 is caused to move in the inserting direction. When the toggle spring peg 21 moves in this way, the arm 18 soon reaches a predetermined rotating position as shown in FIG. 6A, which is a neutral position of the toggle mechanism, in which the shaft 19, the toggle spring peg 21, and the shaft 22 are arranged in a straight line and in which no rotation moment is applied to the arm 18.

Next, when, after this position is reached, the sheet containing cassette 6 is further inserted, the neutral positional relationship of the toggle mechanism is dissolved, and thereafter, the arm 18 starts to rotate by the contracting force of the toggle spring 20, using the shaft 19 as the pivot, with the engagement pin under the influence of the action force due to the rotation moment being drawn along the guide groove 24. That is, when the neutral positional relationship of the toggle mechanism is dissolved, the engagement pin 13 is drawn along the guide groove 24 by the contracting force of the toggle spring 20.

Figure 6B:
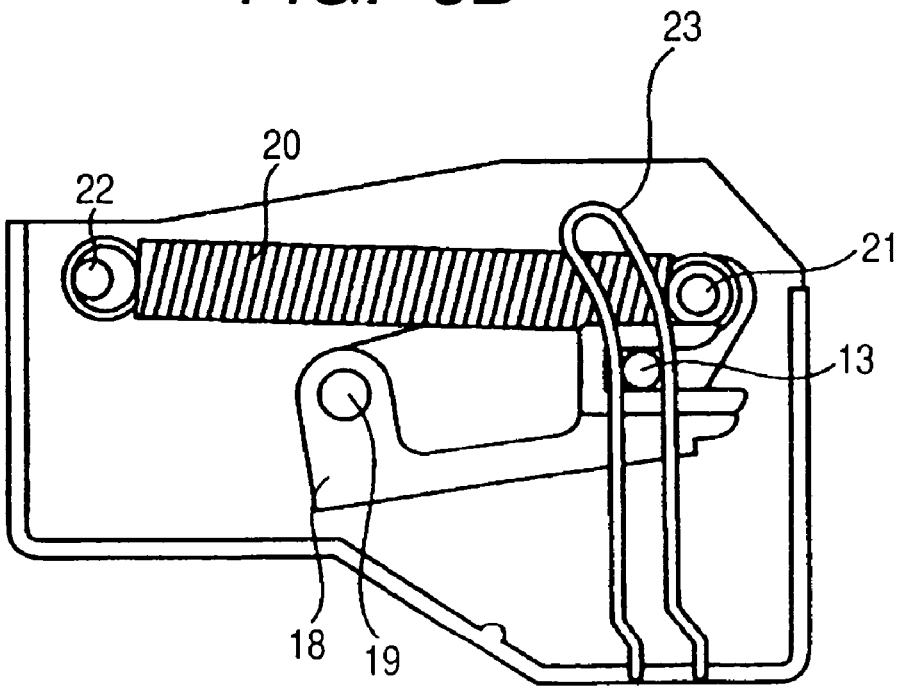

Here, at the stage of drawing up to the moment that the state as shown in FIG. 6B is attained, due to the nature of the toggle mechanism, when the arm 18 rotates, the arm rotating direction component increases due to the contraction of the toggle spring 20, so the rotation moment increases. When the engagement pin 13 further moves linearly along the guide groove 24, the engagement pin 13 makes a relative movement toward the depth side of the grasping groove 18*a*, so the position of the point of action of the rotation moment on the arm 18 moves so as to approach the rotation center 19, which is the rotation center of the arm 18, and action force increases, resulting in an increase in drawing force as shown in FIG. 7.

Figure 7:
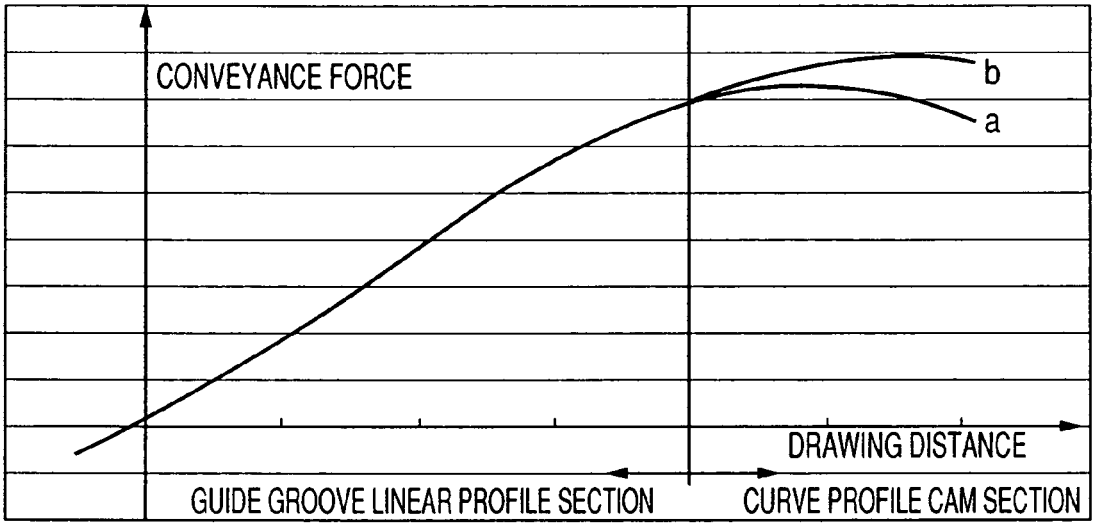
FIG. 7 is a diagram in which the conveyance force (drawing force) of the drawing portion and that of a conventional drawing portion are compared with each other.
Figure 8:
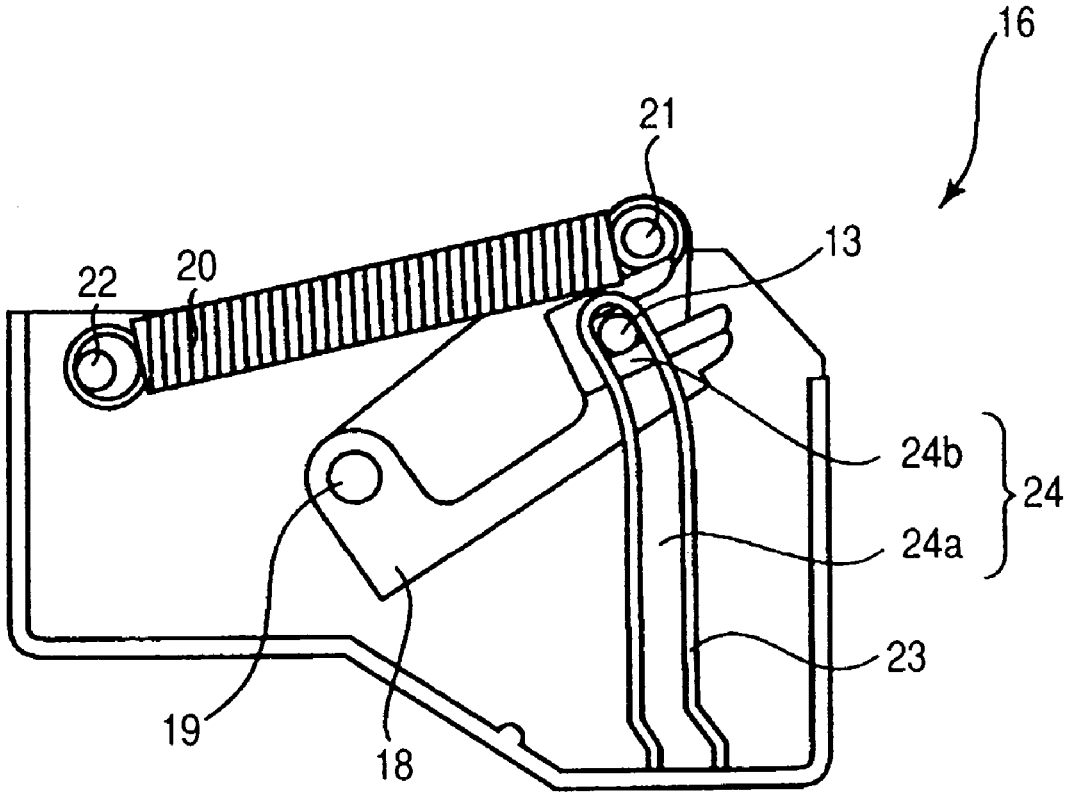
FIG. 8 is a diagram showing a state in which the drawing portion has drawn the sheet containing cassette to a feed position.

Incidentally, during the drawing in the end region of the sheet containing cassette drawing section from the position shown in FIG. 6B to the position shown in FIG. 8, when, for example, as in the case of FIGS. 9A and 9B described above, the engagement pin 13 is drawn straight, the point of action of the rotation moment moves away from the shaft 19 of the arm 18, resulting in a reduction in conveyance force as indicated by reference symbol a in FIG. 7. In this embodiment, in contrast, the guide groove 24 is formed as an arc whose center is the shaft 19 of the arm 18, so it is possible to guide the engagement pin 13 such that the point of action of the rotation moment acting on the engagement pin 13 does not move away from the shaft 19. Due to this arrangement, it is possible to prevent a reduction in drawing force as indicated by reference symbol b in FIG. 7.

In this way, on the downstream side with respect to the attaching direction of the linear portion 24*a* (which is parallel to the cassette inserting direction) of the guide groove 24 provided in the guide member 23, there is provided the curved portion 24*b* curved so as not to extend away from the shaft 19 of the arm 18. As a result, it is possible to prevent a reduction in the conveyance force for the sheet containing cassette 6, and to secure a sufficient conveyance force to cope with the increase in conveyance resistance in this section.

Due to this construction, it is possible to increase the conveyance force solely in the portion where the conveyance resistance increases without increasing the spring pressure of the toggle spring 20, with the result that the sheet containing cassette 6 can be reliably drawn. Further, by making the center of the arcuate configuration of the curved portion 24*b* of the guide groove 24 identical with the shaft 19 of the arm 18, the sliding friction between the guide member 23 and the engagement pin 13 is substantially reduced, making it possible to draw the sheet containing cassette 6 efficiently. Further, due to the efficient transmission of force, there is no need to make the toggle spring 20 unnecessarily strong, so there is no fear of a deterioration in usability when the user draws out the sheet containing cassette 6.

FIGS. 9 through 12A and 12B show another embodiment.

This embodiment differs from the above embodiment in that there is provided a mechanism for slowly rotating the arm 18 so as not to rotate fast, and that there is provided a restoring mechanism for restoring the arm 18 forcibly to the home position. Otherwise, this embodiment is of the same construction and operation as the above embodiment, so the components that are the same as or equivalent to those of the above embodiment are indicated by the same reference symbols, and a description thereof will be omitted.

Figure 11:
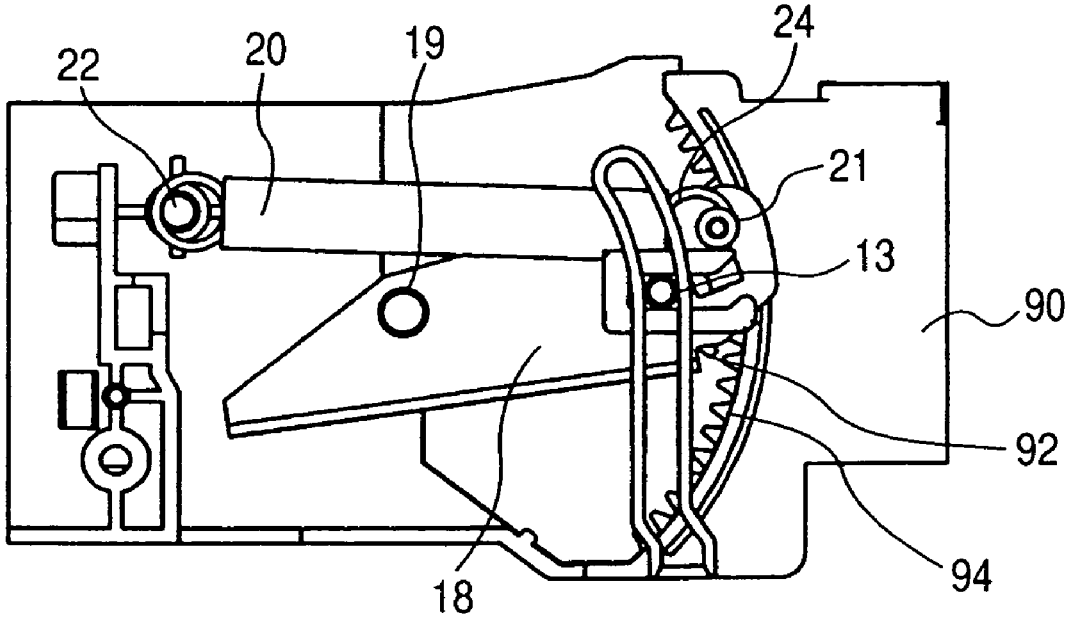
FIG. 11 is a diagram illustrating the operation of the drawing portion of the embodiment of FIG. 9.

First, as a mechanism for slowly rotating the arm 18 so as not to rotate fast, a rotary damper 92 (shown in FIG. 9) is rotatably mounted to the lower surface of the arm 18, and an arcuate rack 94 (shown in FIG. 11) is mounted to a base 90 (shown in FIG. 11). The rack 94 is arranged to extend in an arc whose center is the shaft 19 of the arm 18. Due to this arrangement, as shown in FIG. 11, when the sheet containing cassette 6 is drawn, the arm 18 rotates, with the rotary damper 92 moving along the rack 94 while rotating, to thereby making it possible to perform the operation of drawing the sheet containing cassette 6 slowly.

This construction, which employs the rack 94 and the rotary damper 92, is also applicable to the above-described embodiment.

Figure 10:
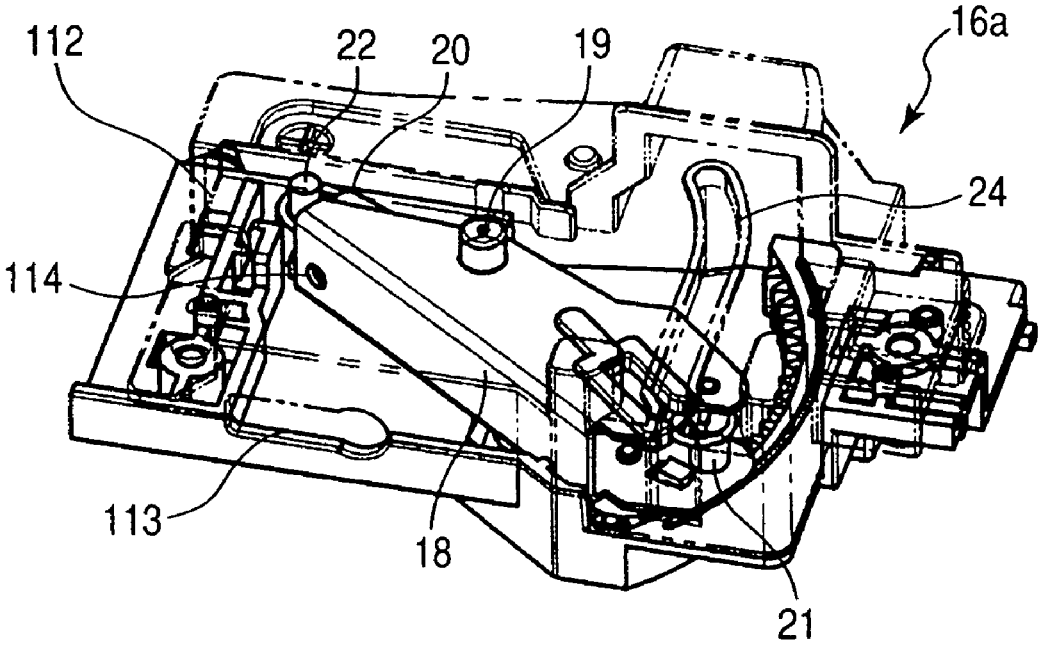
FIG. 10 is a perspective view of a main portion of the embodiment of FIG. 9.

Next, the restoring mechanism for forcibly restoring the arm 18 to the home position will be described with reference to FIGS. 10, 12A and 12B.

In the above embodiment, when a vibration or shock is applied to the apparatus main body, with the sheet containing cassette 6 drawn out, the vibration or shock may be transmitted to the arm 18, and there is a fear of a movement of the sheet containing cassette 6 in the drawing direction occurring although the sheet containing cassette 6 has not been inserted beyond the neutral point of the toggle spring 20 yet. In this case, the arm 18 is not at the home position, where it ought to be situated, so no cassette drawing operation is effected when the sheet containing cassette 6 is to be inserted. Further, even if the sheet containing cassette 6 is pushed in, the sheet containing cassette 6 cannot be inserted so as to reach the feed position due to interference of the engagement pin 13 and the arm 18.

In order that the arm 18 may not be moved by a vibration or shock, it might be possible to set the standby position for the arm 18 at a position greatly deviated in phase from the neutral position of the toggle spring 20. In that case, however, a great force would be exerted in a direction opposite to the cassette inserting direction. Thus, when inserting the sheet containing cassette, the user would have to push the cassette in with a great force, resulting in a deterioration in usability.

In view of this, this embodiment employs a restoring mechanism for the toggle mechanism as described below for coping with such a situation.

As shown in FIG. 7, the drawing portion 16*a* is covered with a cover 112 so that the user, etc. may not touch the drawing portion 16*a* when attaching or detaching the sheet containing cassette 6. The cover 112 has an opening 113 small enough to prevent intrusion of a human finger. On the other hand, the arm 18 is provided with a hole 114 as restoring means. The hole 114 and the opening 113 are provided on the opposite side, with respect to the shaft 19, of the portion where the engagement pin 13 provided on the sheet containing cassette 6 and the arm 18 are engaged with each other. Thus, access to the hole 114 of the arm 18 is possible with a thin bar-like member through the opening 113 of the cover 112 from the front side (the sheet containing cassette 6 attachment opening side) of the apparatus main body.

Figure 12A:
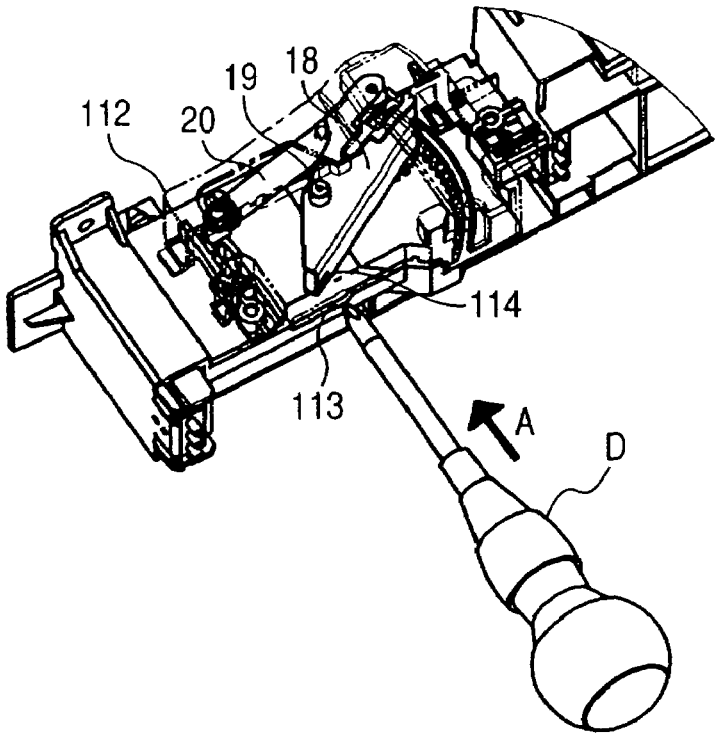
FIGS. 12A and 12B diagrams illustrating a method of restoring the drawing portion of the embodiment of FIG. 9 to a home position.
Figure 12B:
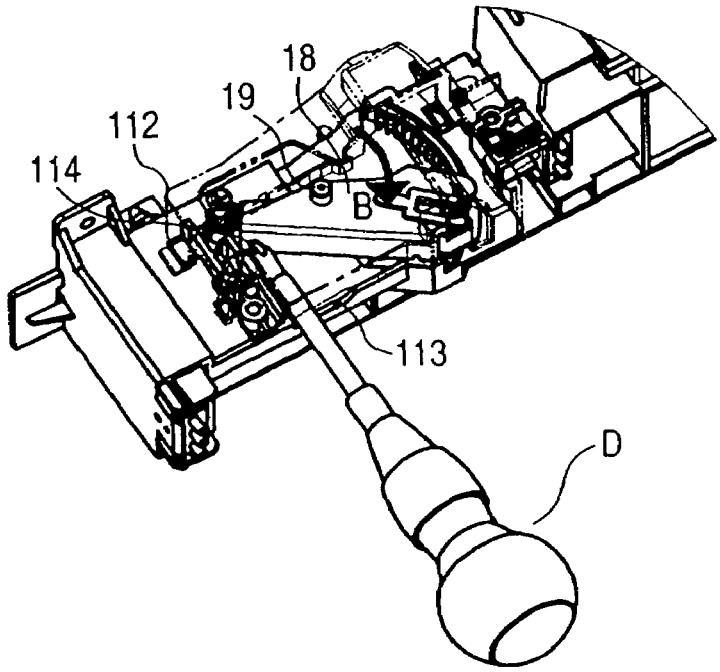
Figure 13A:
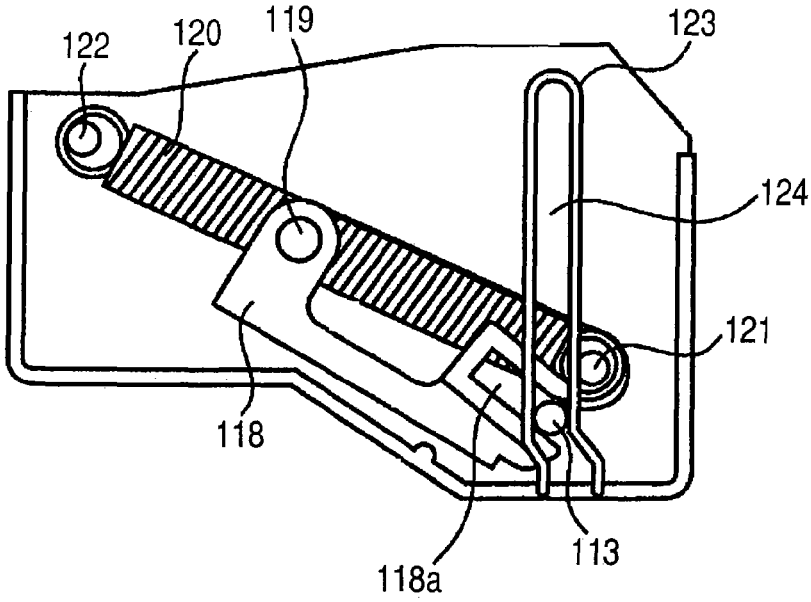
FIG. 13A PRIOR ART
FIGS. 13A and 13B are diagrams illustrating the sheet containing cassette conveying operation of a conventional automatic sheet containing cassette conveying mechanism.
Figure 13B:
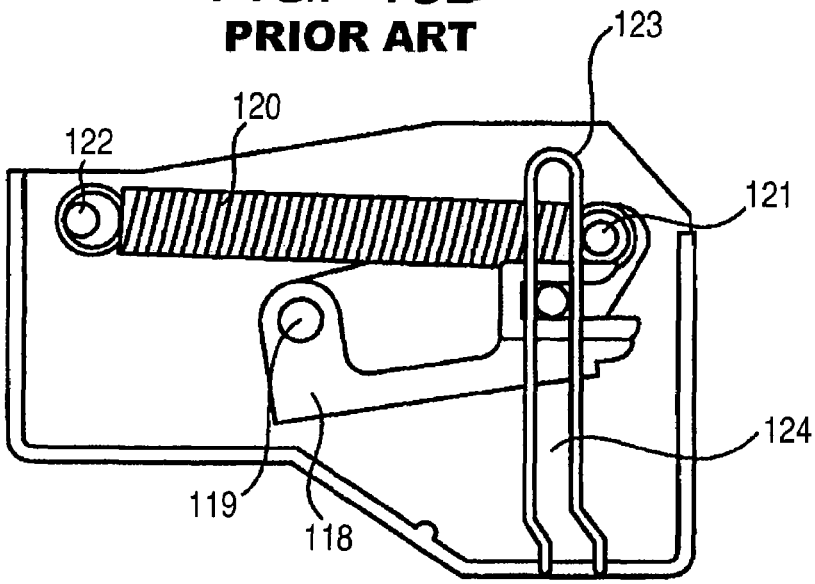
FIG. 13B PRIOR ART

When a vibration or shock is applied to the apparatus main body, with the sheet containing cassette 6 detached, the vibration/shock may be transmitted to the arm 18, causing the arm 18 to be deviated from the home position and to move to the position as shown in FIG. 12A. In such a case, a driver D or the like is inserted in the direction of an arrow A, and the tip of the driver D is engaged with the hole 114; when, in this state, the arm 18 is pushed in, the arm 18 rotates in the direction indicated by an arrow B as shown in FIG. 12B, thus enabling the arm 18 to be restored to the home position. Due to this arrangement, even if it becomes impossible for the drawing portion 16*a* to draw the sheet containing cassette 6 due to a vibration, shock, etc., recovery can be easily effected by the serviceman or the like with a common tool, such as a driver, without having to detach the drawing portion 16*a*.

While in this embodiment, as described above, the hole 114 is used as the restoring means, it is also possible to adopt a protruding configuration as long as it effects engagement when a bar-like object is inserted.

This application claims priority from Japanese Patent Application Nos. 2004-313526 filed Oct. 28, 2004 and 2005-290534 filed on Oct. 3, 2005, which are hereby incorporated by reference herein.

What is claimed is:

1. An image forming apparatus in which a sheet containing unit containing a sheet is detachably attached to a containing portion provided in an apparatus main body, comprising:

an engagement portion rotatably provided on the sheet containing unit;

a drawing unit which is rotatably provided in the containing portion as a pivot, the drawing unit being engaged with the engagement portion and being rotated to draw the sheet containing unit in the containing portion by a spring when the sheet containing unit is inserted to the containing portion; and a guide unit which, when the drawing unit is being rotated to draw the sheet containing unit, guides the engagement portion in a drawing direction of the sheet containing unit, wherein the guide unit is composed of a linear portion parallel to the drawing direction of the sheet containing unit, and a curved portion provided on a downstream side of the linear portion with respect to the drawing direction, the curved portion being curved not to be away from the pivot of the drawing unit, and wherein the engagement portion is guided along the linear portion and the curved portion of the guide unit.

2. An image forming apparatus according to claim 1, wherein the curved portion is formed as an arc whose center is the pivot of the drawing unit.

3. An image forming apparatus according to claim 1, further comprising a toggle mechanism for rotating the drawing unit by a spring, wherein, after the drawing unit has been engaged with the engagement portion and rotated to a predetermined position, the drawing unit is rotated by the toggle mechanism.

4. An image forming apparatus according to claim 1, wherein the engagement portion is swingable in a direction substantially perpendicular to the drawing direction of the sheet containing unit.

5. An image forming apparatus according to claim 1, wherein the guide unit is a groove, along which the engagement portion is guided.

6. An image forming apparatus in which a sheet containing cassette containing a sheet is detachably attached to a containing portion provided in an apparatus main body, comprising:

an engagement pin rotatably provided on the sheet containing cassette;

an arm which is rotatably provided in the containing portion as a pivot, the arm being engaged with the engagement pin and being rotated to draw the sheet containing cassette in the containing portion by a spring when the sheet containing cassette is inserted to the containing portion; and a groove which, when the arm rotates to draw the sheet containing cassette, guides a movement of the engagement pin in a drawing direction of the sheet containing cassette, wherein the groove is composed of a linear portion parallel to the drawing direction of the sheet containing cassette, and a curved portion which is provided on a downstream side of the linear portion with respect to the drawing direction, the curved portion being curved not to be away from the pivot of the arm, and the engagement portion is guided along the linear portion and the curved portion of the groove.

7. An image forming apparatus according to claim 6, wherein the curved portion is formed as an arc whose center is the pivot of the arm.

8. An image forming apparatus according to claim 6, further comprising a toggle mechanism for rotating the arm by a spring, wherein, after the arm has been engaged with the engagement portion and rotated to a predetermined position, the arm is rotated by the toggle mechanism.

9. An image forming apparatus according to claim 6, further comprising a restoring mechanism which, when the position of the drawing arm in a rotating direction is deviated from a home position for engagement with the engagement pin, the restoring mechanism moves the drawing arm to the home position.

* * * * *